US006053662A

United States Patent [19]

Scuero

[11] Patent Number: 6,053,662

[45] Date of Patent: Apr. 25, 2000

[54] PANEL ASSEMBLY FOR RCC DAM AND CONSTRUCTION METHOD

[75] Inventor: Alberto M. Scuero, Lugan, Switzerland

[73] Assignee: PPEL Joint Venture, Lexington, Ky.

[21] Appl. No.: 09/085,896

[22] Filed: May 27, 1998

[51] Int. Cl.[7] ..... E02B 7/02

[52] U.S. Cl. ..... 405/107; 405/52; 405/270; 405/109

[58] Field of Search ..... 405/107, 303, 405/36, 52, 270, 108–113

[56] References Cited

U.S. PATENT DOCUMENTS

| | | | |
|---|---|---|---|
| 2,816,323 | 12/1957 | Munger | 405/155 X |
| 4,659,252 | 4/1987 | Sexton et al. . | |
| 4,804,293 | 2/1989 | Varkonyi et al. . | |
| 4,832,528 | 5/1989 | Lisart | 405/107 X |
| 4,913,583 | 4/1990 | Ledeuil . | |
| 4,965,097 | 10/1990 | Bach | 405/258 X |
| 5,143,480 | 9/1992 | Scuero . | |
| 5,176,025 | 1/1993 | Butts . | |
| 5,490,744 | 2/1996 | McNeil | 405/303 |
| 5,507,900 | 4/1996 | Mohammed et al. . | |
| 5,544,976 | 8/1996 | Marchbanks . | |
| 5,870,871 | 2/1999 | Stewart | 405/303 X |
| 5,915,886 | 6/1999 | McNeil | 405/52 X |

*Primary Examiner*—Dennis L. Taylor
*Attorney, Agent, or Firm*—King and Schickli, PLLC

[57] ABSTRACT

A panel assembly to be used in an RCC dam structure, or the like, includes a precast concrete panel, a geomembrane liner extending over the full face of the panel and a geotextile sheet backing on the liner directly attached to the panel. The liner seals the panel against water leakage in a manner that allows shifting of the dam structure without placing undue stress on the liner or the interconnecting sealing strips. The geotextile sheet is preferably fabricated of a mat of non-woven polyester fibers and the geomembrane liner is preferably polyvinylchloride. The geotextile sheet is attached by hardened concrete slurry integral with the panel. Once the panel assembly is connected to adjacent panel assemblies by the sealing strip to form the dam structure, stress concentrations are relieved in the event that the panels shift for any reason. In the related method, the panel assembly is formed by filling a form with flowable concrete, placing the liner with the geotextile backing on the concrete, providing a slurry under the face of the geotextile backing in order to penetrate the interstices and allow the concrete to cure for attachment to the panel. Vibrating the liner enhances formation of the slurry in contact with the backing.

19 Claims, 2 Drawing Sheets

PANEL ASSEMBLY FOR RCC DAM AND CONSTRUCTION METHOD

TECHNICAL FIELD

The present invention relates generally to dam structures, or similar water retention structures, and more particularly to an improved panel assembly for constructing such a structure for retaining or controlling water, such as in a reservoir.

BACKGROUND OF THE INVENTION

Within recent years, the method of constructing dams using the roller compacted concrete (RCC) technique has become more and more popular. This type of construction is quickly replacing earth or rock filled dams, primarily because of the relatively low initial cost, but also because of the more efficient construction that substantially eliminates leaking, and thus provides the resultant lower maintenance costs. Indeed, with the latest construction techniques being used, the RCC dam can compete on some sites with the more traditional poured mass concrete dams.

The standard of the RCC dam technique utilizes a plurality of precast concrete panels that are erected to form a generally vertical wall facing upstream. A liner is provided on the downstream side of the precast panels and a poured concrete curtain wall is placed against the liner. Behind the curtain wall a damp gravel fill is blended with cement and applied in layers. Each layer is compacted by rolling to complete the construction.

This basic RCC dam construction and method is disclosed and claimed in prior U.S. Patent to Sexton et al. U.S. Pat. No. 4,659,252. The actual implementation of this construction has proven to be highly successful over the years. Not only is the cost of construction compatible with other ways of constructing dams, either earth or rock filled dams or poured mass concrete dams, the RCC dam construction has proven to have the best record in terms of controlling continuing maintenance cost.

However, one key problem that has arisen that was not originally anticipated is concerned with the attachment of the plastic liner to the face of the precast concrete panels. Originally, raised T-shaped bars were included on the backside of the plastic liner for embedding into the cast concrete panel. While this approach has proven successful, one potential shortcoming has been identified. After erection of the dam, if there is a slight shift in the foundation due to unexpected settling and/or an earth tremor occurs in the area, the T-shaped bars are not as forgiving as is desirable. In effect, the bars secure the liner to the precast panels in a semi-rigid fashion, so that when a shift occurs undesirable stress concentrations can occur in the liner and/or the elongated sealing strips. The undue stressing of the liner and the sealing strip can eventually lead to weakening of the dam structure and cause an increased maintenance cost, such as represented by a need for resealing of the site involved.

Recently, the application of polymer sheets for outdoor use to form protective barriers and covers of many types have become more and more popular. In broad terms, these sheets have become known as geomembranes, and in particular are used not only for dam structures, as described in the '252 patent, but are also recognized for use in like structures, such as ponds, hazardous waste containment pits, landfills, canals, tunnels, and the like. It is also known to provide the geomembranes with a backing of non-woven or woven synthetic material, known as geotextiles. In its broadest sense, this type of plastic or polymer sheeting with a fabric backing is offering advantages of not only lower cost, but also more efficient performance and ease of installation into the particular containment assembly involved. In its broadest sense, the geomembrane and geotextile form a geocomposite, as is illustrated and described best in U.S. Pat. No. 5,507,900, and the references cited therein, and this patent is incorporated herein by reference.

In my previous U.S. Pat. No. 5,143,480 I have described a dam structure and a method for protection of the dam structure from excess moisture utilizing this geocomposite. In this prior patent, the liner is placed on the upstream side of the dam, such as a poured mass concrete dam, and has overlapping edges for sealing between the individual sheets. The geotextile backing is attached to a mesh semi-open sheet that allows drainage of all moisture, such as condensation, to protect the dam structure.

Similarly, there have been other uses of geomembranes in dam like structures where modules are formed with spacers and attached by flanges or other mechanical fasteners. One example of this type of prior art structure is shown in the Ledeuil U.S. Pat. No. 4,913,583. Still today, as represented by the Lisart U.S. Pat. No. 4,832,528, a significant faction proposes precast panels without the benefit of geomembrane sealing.

Accordingly, while geomembranes and/or the combination with a backing of geotextiles is known in the art of constructing hydraulic structures, and in particular with regard to use in RCC dam construction, to date the application of this technology has been for uses other than the type of use in the standard RCC dam, as shown and described in the '252 patent. It is also clear that the prior proposed uses have not addressed the problem of minimizing the stress in the plastic liner of the dam that can be caused by a slight shifting in the panels after the construction of the dam is finished. Thus, there is a need to provide an improved panel assembly for a dam structure or the like, and an improved method of construction. The panel assembly and method should make the best use of the geomembrane liner. It is contemplated that adding a geotextile sheet backing to form the geocomposite can assist in this purpose. Overall, there should be a dramatic improvement in the sealing of the individual panels, and to do so in a manner and to minimize the stress concentration in the geomembrane during the life of the dam.

SUMMARY OF THE INVENTION

Accordingly, the primary object of the present invention is to provide an improved preformed panel assembly for use with adjacent like assemblies to form a dam structure, or similar hydraulic retention or control structure, overcoming the above described limitations and disadvantages of the prior art.

Another object of the present invention is to provide a panel assembly for a dam structure or the like wherein a geomembrane liner with a geotextile sheet backing is attached directly to the panel to guard against water leakage in an efficient manner.

A further object of the present invention is to provide a panel assembly of the type described wherein the geomembrane liner is utilized with a geotextile sheet backing that allows attachment to the panel by hardened concrete slurry.

It is still another object of the present invention wherein the panel assembly of the present invention utilizing a geomembrane liner is adapted to be combined with others, and sealed to form a dam structure and wherein the controlled separation of the geotextile sheet from the geomembrane liner and/or from the hardened concrete allows the liner to behave elastically during shifting of the panels, so as to minimize stress concentrations in the liner and the sealing strip.

It is still another object of the present invention to provide such a panel assembly wherein the geomembrane liner with geotextile backing attached directly to the precast concrete panel provides reduced cost, greater flexibility, improved liner properties, easier handling during construction, as well as the better ability to resist stress concentrations.

Another and related object of the present invention is to provide a method of forming the panel assembly for use to form such a dam structure, or similar hydraulic structure, wherein a full face geotextile backing on the geomembrane liner is placed directly on concrete slurry during the precast forming, thus allowing the concrete to set to form a full face attachment that is secure, making the panel assembly easier to handle without damage, especially to the edges, but at the same time capable of forgiving or relief in the form of controlled separation from the geomembrane to minimize possible stress concentrations in the liner once installed to form the dam structure.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of this invention, an improved panel assembly is provided, and is contemplated to be utilized for retaining water in a reservoir, or for other similar hydraulic applications. In the preferred embodiment shown for purposes of illustrating the invention, a dam structure includes a plurality of precast concrete panels, each with an impermeable, full face geomembrane liner attached to the panel. In order to form the attachment, a geotextile sheet backing is attached to the liner and is in direct contact over substantially the corresponding full face of the panel. Within the broadest aspects of the present invention, this geocomposite provides for sealing of a panel against leakage in a very efficient manner. In addition, this feature improves the constructability of the dam structure, since the geocomposite is securely held against the panel in all areas. It is especially important that there are no loose edges that might be damaged during handling.

The preferred embodiment of the complete dam structure, or the like, is formed in accordance with the teachings of the basic '252 patent that has become the standard in the industry. For example, these panel assemblies are placed together to form a vertical wall with the geomembrane liners specifically positioned on the downstream side of the panels. However, other arrangements and other applications to hydraulic retention and controlling structures, are within the broadest aspects of the present invention.

Preferably, the geotextile sheet backing is fabricated of a mat of non-woven polyester fibers having a density in the range of 150–200 grams per square meter ($g/m^2$) that is heat bonded to the liner, preferably just after extrusion, such as by rolling under pressure. The fibers can be of random shape and form, or can be substantially uniform, such as small hooks, as found for example on the two components of a Velcro fastener.

The bonding is gauged to be secure, but capable of controlled separation to provide relief to minimize stress concentration in said liner in the event there is a shift in the panels. This action provides the necessary relief or forgiveness to prevent undue stress in the liner/sealing strips. This improved flexibility and resistance to stress concentrations assures that the dam structure remains free of potential leakage sites that would otherwise have to be repaired.

The geomembrane liner is preferably polyvinylchloride, having a thickness of approximately 2 millimeters (mm), but of course in accordance with the broader aspects of the present invention the liner can be other plastics, and/or rubber sheeting to provide the required sealing function as taught in the '900 patent, mentioned above.

In accordance with another feature of the invention, the geotextile sheet backing is attached to the concrete panel by hardened concrete slurry integral with the panel. Assuming the backing has the preferred density in the range of 150–200 $g/m^2$ the attachment to the concrete panel is stronger than the bond of the backing to the liner so that the controlled separation occurs as described above. Within the broadest aspects of the invention, the relative strengths of the attachments can be reversed so that if there is a shift in the panels, the geotextile can fully or partially separate from the concrete. Also, it is to be understood that other appropriate densities and thicknesses of these components are within the broader teachings of the present invention, and can be utilized as required by any particular type or size of dam structure, or the like.

The peripheral edges of each panel assembly are heat welded and sealed by a geomembrane sealing strip without a backing and that overlaps from one panel assembly to the other. The dam structure is made totally waterproof after being completed in this manner. As mentioned above, in the event that there is a slight shifting between the panel assemblies after completion of the structure, such as caused by an earth tremor or earthquake, the geotextile sheet backing undergoes the controlled separation, preferably from the geomembrane, thus relieving the joint formed by the overlapping sealing strip and thereby minimizing stress concentrations in the liner and the strip.

In the related method of forming the panel assembly of the present invention, the first step is to fill a form the size of the panel with wet, flowable concrete. The geomembrane liner with the full face geotextile backing is placed on top of the concrete before it has a chance to harden. The wet concrete forms a slurry under the face of the geotextile backing so as to allow penetration of the interstices of the backing. The concrete is allowed to set thereby providing the attachment of the backing, and thus the liner, to the panel. The attachment as thus formed is secure over its full face so that there are no loose areas, particularly around the edges.

Preferably, the slurry formed on top of the poured concrete in the form is enhanced by vibrating or rolling the liner, which causes the aggregate material in the concrete underneath to partially settle. The layer of slurry remaining on top of the concrete in this instance is substantially free of aggregate material, thus allowing more complete penetration into the interstices of the backing. The step of vibrating the liner is preferably carried out by extending an elongated trowel across the form and activating a high frequency, low amplitude vibrator on the trowel.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification, illustrates several aspects of the present invention and together with the description serves to explain the principles of the invention. In the drawings.

Reference will now be made in detail to the present preferred embodiment of the invention, an example of which is illustrated in the accompanying drawings.

DETAILED DESCRIPTION OF THE PREFERRED EMBODIMENT

Figure 1:
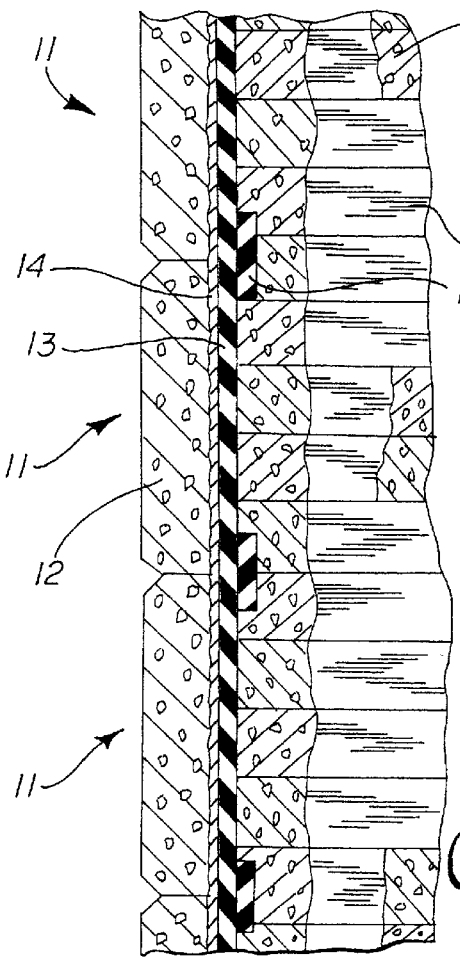
FIG. 1 is a cross section of the dam structure, illustrating a plurality of panel assemblies, including the attached geomembrane with an attached geotextile backing and showing the sealing strip between adjacent panel assemblies for forming the complete dam structure.
Figure 3:
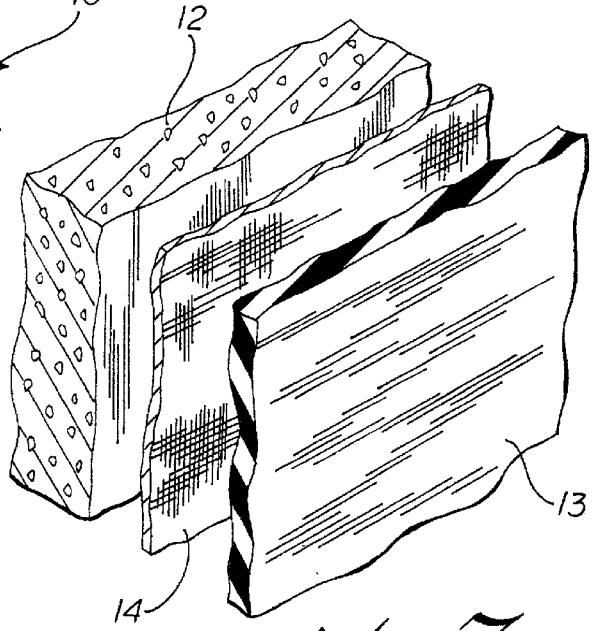
FIG. 3 is a perspective exploded view showing the geomembrane liner, the geotextile backing and the precast concrete panel, all cut away in cross section for clarity.

Referring to FIG. 1 of the drawings, the improved panel assembly of the present invention is illustrated in combination with adjacent panel assemblies to form a dam structure 10. As indicated above, the particular preferred embodiment chosen to illustrate the invention, is a roller compacted concrete (RCC) dam for retaining water in a reservoir. While the RCC dam 10 is a structure that takes full advantage of the features of the present invention, it is to be understood in the manner explained above that other like structures for retaining and/or controlling water are deemed to be within the broadest aspects of the present invention.

Thus, the dam 10 is made up of a plurality of panel assemblies 11 that are positioned one on top of the other to form a wall to retain water in a reservoir, which in FIG. 1 is to the left (not shown). Each panel assembly includes a precast concrete panel 12 and an impermeable, full face geomembrane liner 13 on the downstream side of the panel 12. Sandwiched between the panel 12 and the liner 13 is a geotextile sheet backing 14. As indicated above, the backing 14 is permanently attached to the liner 13 without fasteners, and extends substantially over the full face of the panel 12. This full face feature enhances the constructability of the dam by making the panel assemblies easier and safer to handle. There are no loose areas of the liner, as are possible to have when using the prior art spaced T-bars, or other fasteners. The edges are tightly adhered to the panel 12 so that during storage on the edge and/or handling, the geomembrane is not subject to being damaged. In accordance with another aspect of this feature, although the liner 13 is fully and securely adhered, it is capable of controlled separation from the backing to protect against undue stress concentration, as will be described more in detail below.

As also illustrated in FIG. 1, the preferred embodiment includes a vertical curtain wall 15 that is formed in sections along the downstream side of the liner 13. As clearly set forth in the '252 patent, the curtain wall 15 is formed by poured concrete as the dam 10 is raised progressively during construction. Behind the curtain wall 15 are provided the RCC layers 16 applied in the manner also described in the '252 patent.

Figure 2:
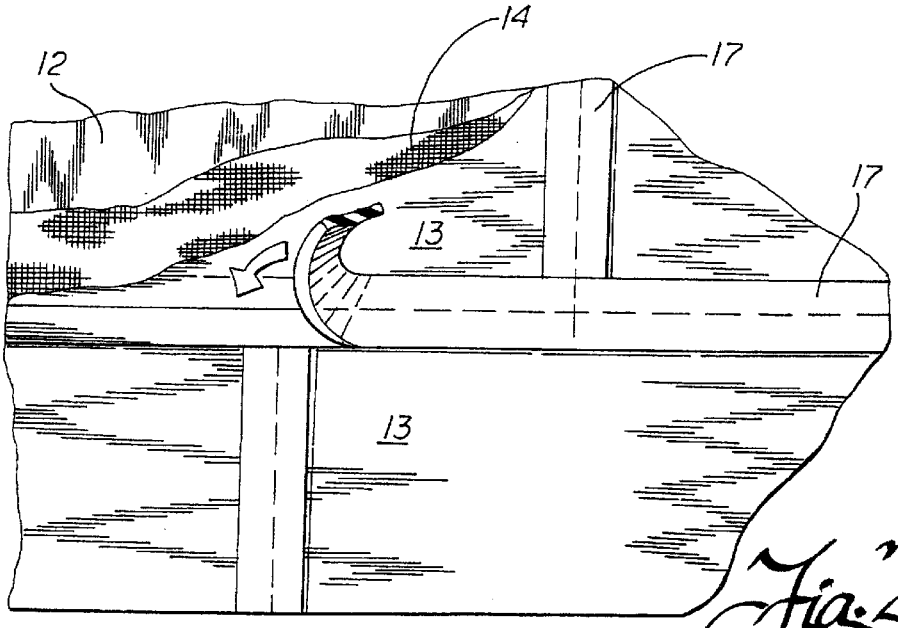
FIG. 2 is a cut away downstream face view of the dam structure constructed in accordance with the teachings of the present invention, and illustrating in particular the application of the sealing strip between adjacent panel assemblies, each of which includes a geomembrane liner with a geotextile backing attached to a precast concrete panel.

Between adjacent panel assemblies 11 is a geomembrane sealing strip 17, which is preferably heat welded to provide the interconnection between adjacent liners 13, as illustrated. Of course, the sealing strip 17, as shown being applied in FIG. 2, does not include a backing so that upon welding forms secure and leak free joints along the entire downstream face of the dam 10. The welding of the strip 17 is also brought out in more detail in the prior '252 patent, and the entire disclosure of this patent is incorporated herein for reference.

In accordance with the teachings of the present invention, the geotextile sheet backing 14 is fabricated of a mat of non-woven polyester fibers. The geomembrane liner is preferably a polyvinylchloride sheet (PVC). Depending on the application of the dam 11, the density of the backing 14 and the thickness of the liner 13 and sealing strip 17 can vary. Generally, the density and thickness of these two components increases with the size of the dam and the severity of the conditions of the particular application. As a preferred embodiment illustrated to demonstrate the present invention, the backing has a density in the range of 150–200 g/m$^2$ and the liner has a thickness of approximately 2 mm. For example, this geocomposite, that is, the combination liner and backing, that has these particular specifications is available as an off-the-shelf component from Sibelon, S.p.A of Via M. Bianco, 5-28041, Arona (NO), Italy and is identified by the trademark SIBELON CNT 2800.

According to the present invention, the panel assembly 11 is completely fabricated during precasting the concrete panel 12. While the concrete is in a wet, flowable state, the liner 13 with the backing 14 is placed on top of the concrete. The attachment is made by the wet concrete slurry penetrating the interstices of the mat so that upon curing, the liner is attached to the panel 12. The attachment between the polyester mat of the sheet 14 and the face of the liner 13 can be made in any suitable manner, but preferably the attachment is by heat bonding immediately downstream of the initial extrusion of the liner 13. Other suitable means, such as adhesives, can be used if desired.

Once the concrete of the panel 12 is cured, the completed panel assemblies 11 are erected and the sealing strips 17 are applied by heat welding. As will be explained in more detail below, the nature of the attachment between the backing 14, the panel 12 and the area of the joint between two adjacent panel assemblies 11 is such that undue stress concentrations in the area of these joints are eliminated. As a result, there is an improvement in the integrity of the dam 11 and shifting of the panels is allowed without the potential for creating a site for leakage. As illustrated, the sealing strip 17 overlaps around the full periphery of each panel assembly 11.

Figures 4, 5A, 5B, 6:
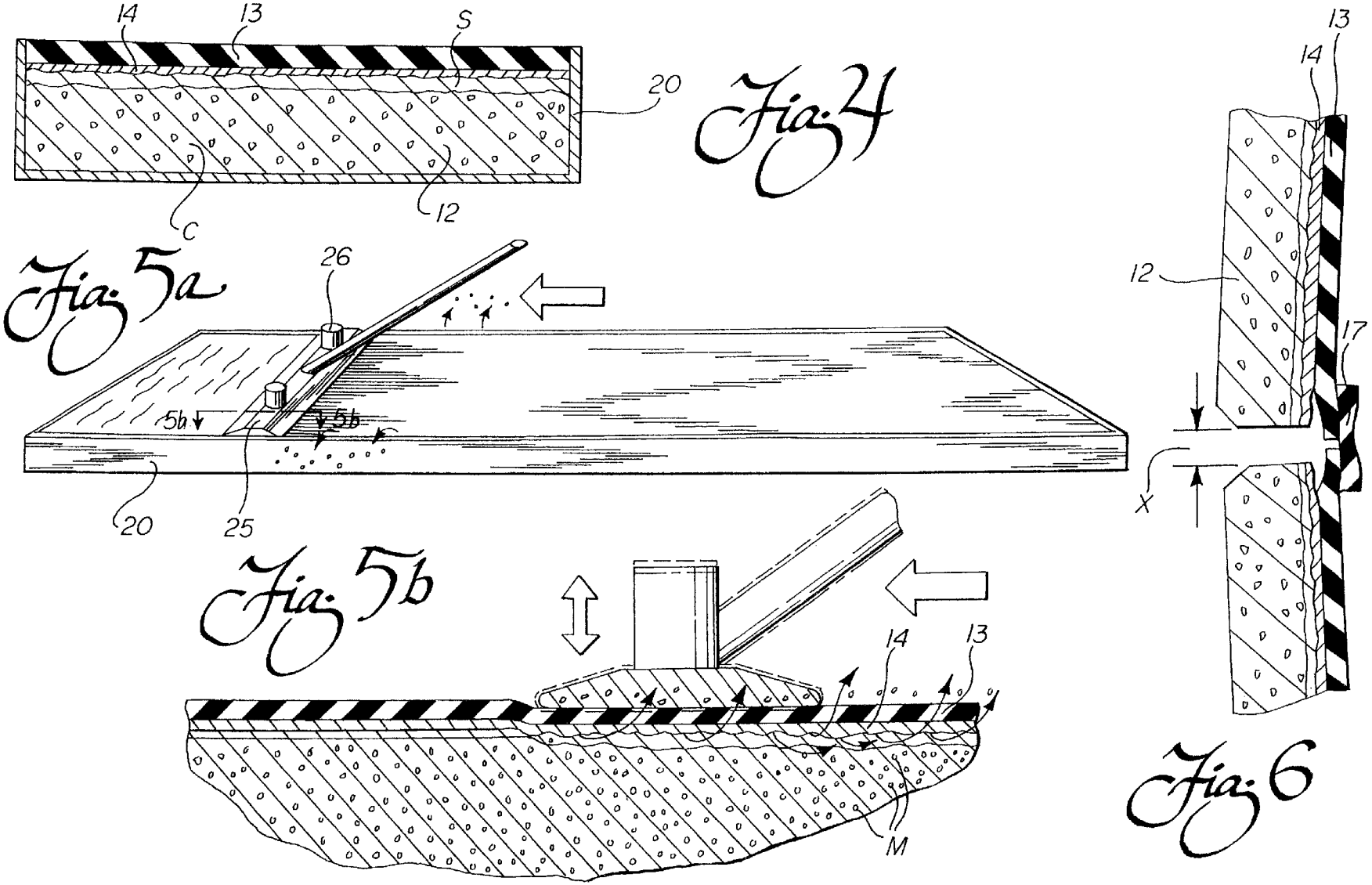
FIG. 4 is a cross sectional view through the form for casting the concrete panel, including the attached geomembrane liner with the geotextile backing in place along the full face of the panel.
FIG. 5*a* is a perspective and top view of the form for forming the panel illustrating a vibrating trowel moving along the length of the form to enhance the formation of a top slurry to attach to the geocomposite.
FIG. 5*b* is an enlarged, cross sectional view of the vibrating trowel taken along line 5*b*/5*b* of FIG. 5*a* and showing the manner in which the slurry layer is formed and enhanced to allow penetration of the interstices of the geotextile backing to provide the panel assembly of the present invention.
FIG. 6 is a broken away cross sectional view and enlarged to show detail of a theoretical test illustrating the relief provided by controlled separation of the liner from the backing to minimize stress concentrations.

As illustrated in FIG. 4, a casting form 20 for forming the panel assemblies 11 is provided in accordance with the preferred embodiment of the related method. As is apparent, the wet, flowable concrete C is placed in the form 20 to provide the panel 12. The sides of the form 20 can be removable to release the panel 12 once the concrete is hardened and cured (not shown). While the concrete is wet, and with a slurry S formed on the top, the geomembrane liner 13 with the attached backing 14 is placed on the slurry S. By rolling, or by vibrating, the layer of slurry S can be enhanced. The wet slurry is forced to penetrate the interstices of the polyester mat, for a secure, but controlled releasable attachment, once the concrete cures.

With reference now to FIG. 5*a*, the preferred method of providing the slurry layer S under the face of the geotextile backing is illustrated. A trowel 25 extends the entire width of the form 20, and is sometimes known in the industry as a "bull float."The ends are preferably supported and guided by the upper edges of the sides of the form 20. A vibratory action is applied to the face of the geomembrane liner 13 by means of vibrator motors 26 on the trowel that are tuned to generate high frequency, low amplitude vibrations. When transmitted to the underlying flowable concrete C, as illustrated in FIG. 5*b*, the slurry layer S is enhanced by settling of the aggregate material M away from the surface. This causes the slurry to more readily enter and penetrate the interstices of the backing 14. This action assures the best possible formation of the desired attachment between the liner 13 and the panel 11. The objective is to have the attachment to be secure, so that it holds during the preferred method step of providing relief by controlled separation between the liner 13 and the backing 14 to minimize stress concentrations, as will now be described with reference to FIG. 6.

The adjacent panels 12 are shown in FIG. 6 separated by an exaggerated distance X, for emphasis. This separation represents an instance where an earth tremor or the like causes the shifting of the panels. Advantageously, the bond between the textile sheet 14 and the liner 13 adjacent the joint fails in a controlled, calculated manner. When this occurs, it allows the geomembrane liner 13 and the geomembrane sealing strip 17 to behave elastically and stretch. As an example, this stretching, and particularly the elongation of the adjacent edges of the liner 13, as well as the sealing strip 17, allows the panel separation of up to 30 centimeters (cm) in the particular liner thickness/backing density described. By testing, the stretching up to 250% of the original liner length can be accommodated. Also, the length of the separation between the liner 13 and the backing 14 is controlled, that is self adjusting, depending on the extent of the shifting of the panel assembly 11. The separation can extend over the entire height of the panel assembly 11, or beyond if necessary, without causing a problem. Of particular importance, this occurs without approaching the level of stress concentration in the geomembranes that could lead to weakening, or eventually to rupture. All that occurs is a harmless stretching and slight narrowing of the geomembranes, and thereby provide for the ability to resist the deleterious stress concentrations that would otherwise occur. The geomembranes maintain their impermeability, and thus their leak free performance.

In summary, the results and advantages of the present invention can now be fully understood. The geomembrane liner 13 extending over the full face of the panel 12 is securely attached through the geotextile sheet 14. The liner 13 advantageously seals the panel against water leakage, and upon the addition of the sealing strip 17 a complete sealing of the dam structure 11 is obtained. In the event that there is a shifting of the panels 12 for any reason, such as an earth tremor or earthquake, there is no undue stress placed on the geomembrane components. The geotextile sheet 14 operates to advantage by controlled separation first from the liner 13 to provide the desired elongation and release of the stress at the joint. In the related method, the panel assembly 11 is formed by filling a form with flowable concrete C, placing the liner 13 with the backing 14 on the concrete so that the slurry under the face of the backing 14 penetrates the interstices and the desired attachment is formed. By vibrating the liner 13 from above after being placed on the form 20, the slurry layer S is enhanced, thus providing increased bonding capability.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as is suited to the particular use contemplated. All such modifications and variations are within the scope of the invention as determined by the appended claims when interpreted in accordance with breadth to which they are fairly, legally and equitably entitled.

I claim:

1. A panel assembly for use with adjacent assemblies to form a dam structure or the like for retaining water in a reservoir comprising:

a substantially flat precast concrete panel;

an impermeable, full face geomembrane liner; and a geotextile sheet backing on said liner attached directly over substantially the corresponding full face of said panel, whereby sealing of said panel against water leakage in said dam structure is provided.

2. The panel assembly of claim 1, wherein said geotextile sheet backing is fabricated of a mat of non-woven polyester fibers.

3. The panel assembly of claim 1, wherein said geomembrane liner is polyvinylchloride.

4. The panel assembly of claim 1, wherein said geotextile sheet backing is attached to said panel by hardened concrete slurry integral with said panel.

5. The panel assembly of claim 2, wherein said geotextile sheet backing has a density in the range of 150–200 g/m$^2$.

6. The panel assembly of claim 3, wherein said geomembrane liner has a thickness of approximately 2 mm.

7. The panel assembly of claim 1, wherein said geotextile sheet backing is heat bonded to said geomembrane to form a secure bond, but capable of controlled separation to provide relief to minimize stress concentrations in said liner.

8. The panel assembly of claim 1, wherein the peripheral edge of said panel assembly is heat sealed to an elongated geomembrane sealing strip overlapping for connection to the adjacent panel assemblies to form said dam structure and minimize stress concentrations in said liner and said strip.

9. The panel assembly of claim 1, wherein said geomembrane liner is on the downstream side of said panel, and the upstream face of the panel directly contacts the water.

10. The method of forming a substantially flat panel assembly for use with adjacent assemblies to form a dam structure of the like for retaining water in a reservoir comprising the steps of:

filling a form for the panel assembly with flowable concrete;

placing an impermeable geomembrane liner having an attachment of a full face geotextile backing on the concrete;

providing a slurry under the face of said geotextile backing to penetrate the interstices of the same; and allowing the concrete to set to form an attachment of the backing to the panel, whereby said attachment between the backing and the liner is secure, but capable of relief to minimize stress concentrations in said liner.

11. The method of claim 10, wherein the step of providing a slurry includes vibrating the liner to settle the concrete underneath and enhance the slurry in contact with the backing.

12. The method of claim 11, wherein the step of vibrating the liner includes extending an elongated trowel across the form, and activating a high frequency, low amplitude vibrator on said trowel.

13. The method claim 10, wherein the attachment of said backing to said liner is provided by the additional step of heat bonding said geotextile backing to said geomembrane liner to form a secure bond, but capable of controlled separation to provide relief to minimize stress concentrations in said liner.

14. A dam formed of a plurality of substantially flat, precast concrete panels for retaining water in a reservoir, each panel comprising:

an impermeable, full face geomembrane liner on said panel;

a geotextile sheet backing on said liner attached directly over substantially the corresponding full face of said panel; and an elastic geomembrane sealing strip forming an overlapping connection between adjacent panels to form said dam and capable of stretching to minimize stress concentrations.

15. The dam of claim 14, wherein said geotextile sheet backing is fabricated of a mat of non-woven polyester fibers.

16. The dam of claim 14, wherein said geomembrane liner is polyvinylchloride.

17. The dam of claim 14, wherein said geotextile sheet backing is attached to said panel by hardened concrete slurry integral with said panel.

18. The dam of claim 14, wherein said geotextile sheet backing is head bonded to said geomembrane to form a secure bond, but capable of controlled separation to provide relief to minimize stress concentrations in said liner.

19. The dam of claim 14, wherein said geomembrane liner is on the downstream side of said panel, and the upstream face of the panel directly contacts the water.

* * * * *